US009050832B2

(12) United States Patent
Grimault

(10) Patent No.: US 9,050,832 B2
(45) Date of Patent: Jun. 9, 2015

(54) CARD FLIPPING DEVICE INTENDED TO BE ATTACHED TO A PRINTER

(71) Applicant: EVOLIS, Beaucouze (FR)

(72) Inventor: Romain Grimault, Beaucouze (FR)

(73) Assignee: EVOLIS, Beaucouze (FR)

( * ) Notice: Subject to any disclaimer, the term of this patent is extended or adjusted under 35 U.S.C. 154(b) by 0 days.

(21) Appl. No.: 14/394,842

(22) PCT Filed: Apr. 22, 2013

(86) PCT No.: PCT/EP2013/058265
§ 371 (c)(1),
(2) Date: Oct. 16, 2014

(87) PCT Pub. No.: WO2013/160231
PCT Pub. Date: Oct. 31, 2013

(65) Prior Publication Data

US 2015/0077499 A1 Mar. 19, 2015

(30) Foreign Application Priority Data

Apr. 27, 2012 (FR) ..... 12 53936

(51) Int. Cl.
*B41J 3/36* (2006.01)
*B41J 3/60* (2006.01)
*B41J 13/00* (2006.01)

(52) U.S. Cl.
CPC ..... *B41J 13/0018* (2013.01); *B41J 3/60* (2013.01)

(58) Field of Classification Search
USPC ..... 347/171, 172, 174, 176, 218; 400/120.01, 188
See application file for complete search history.

(56) References Cited

U.S. PATENT DOCUMENTS 5,326,179 A * 7/1994 Fukai et al. ..... 400/521
5,600,362 A * 2/1997 Morgavi et al. ..... 347/218
5,771,058 A 6/1998 Kobayashi
5,806,999 A * 9/1998 Kobayashi ..... 400/188
6,318,914 B1 11/2001 Cuo et al.

FOREIGN PATENT DOCUMENTS

JP A 2000-251018 9/2000

OTHER PUBLICATIONS

Nov. 6, 2014 Search Report issued in International Patent Application No. PCT/EP2013/058265 (with translation).
Nov. 6, 2014 Written Opinion issued in International Patent Application No. PCT/EP2013/058265 (with translation).

* cited by examiner

*Primary Examiner* — Huan Tran
(74) *Attorney, Agent, or Firm* — Oliff PLC; R. Brian Drozd

(57) ABSTRACT

The present invention concerns a card-flipping device intended to be fixed to a printer, said device including card-driving means for transferring cards from the printer to the inside of this flipping device, and to hold them in position in this flipping device, to flip them and to transfer them once flipped from the inside of this flipping device to the printer, wherein the drive means are movable so as to enable the printer, in order to manipulate a card during a processing operation performed by said printer, to use a space inside the device that is occupied by the drive means when they transfer a card from or to the printer.

4 Claims, 7 Drawing Sheets

CARD FLIPPING DEVICE INTENDED TO BE ATTACHED TO A PRINTER

The present invention concerns a card-flipping device intended to be attached to a printer, and designed to flip a card so that the two faces undergo at least one processing operation performed by the printer. The present invention applies in particular in the field of the thermal printing of plastic cards.

Printers provided with a device for flipping a card to be printed are known. Such printers perform processing operations on one or other or both faces of the cards during the printing. For example, these printers are suitable for effecting an encoding of chips mounted on the cards, for printing images and text on one or both faces of these cards or encoding a magnetic strip.

Such operations require translation movements of the cards, which are transferred along a transfer path between the modules of the printer executing these operations. In addition, as processing operations must usually be applied to both faces of the cards, these cards must be turned over during printing thereof by a flipping device.

To this end, as illustrated in FIG. 1, it is usual for a flipping device D to be mounted on a printer I so as to be placed on the path CT for transferring the cards during processing thereof by processing modules MT of the printer I. Thus the cards 10 travel along this transfer path CT for processing of one of the faces thereof, are turned over the by flipping device D, which is situated, as illustrated in FIG. 1, on the transfer path, and then move off again on this transfer path CT once flipped so that the other face of these cards is processed by the appropriate processing modules MT. The movement of the cards 10 is illustrated by the bold arrow in FIG. 1.

This type of printer is bulky since it is necessary to leave a space ESP between the processing modules MT and the device D. This space is in general equal to (or even greater than) the length of a card so that the card 10 can emerge fully from the processing modules MT and move off again towards these modules without the card 10 being turned over and coming up against the flipping device D.

The problem to be addressed is reducing the bulk of the printer/card-flipping device assembly compared with the solutions of the prior art.

To this end, the present invention concerns a card printer comprising:

a transfer path along which said card moves, a processing module intended to perform a processing operation on said card, a flipping device comprising means for driving the card, the flipping device being able to move in rotation between a first position in which said drive means are positioned on the transfer path, another first position in which said drive means are positioned on the transfer path at 180° with respect to said first position, and a second position in which said drive means are not positioned on the transfer path, and a motor intended to position the flipping device in said first position so as to transfer said card from the processing module to the flipping device, in said other first position so as to transfer said card from the flipping device to the processing module, and in the second position when the card is processed by the processing module.

Thus the size of the printer/card-flipping device assembly is reduced compared with the solutions of the prior art. This is because the movements of the drive means release a space that is used by the printer for manipulating the cards. The printer is therefore more compact. This is because the dimensions of the printer can be reduced by a volume equal to the space left clear inside the flipping device by the movement of the drive means.

Advantageously, the drive means are rollers functioning in pairs.

Advantageously, one of the rollers in a pair is a cleaning roller.

This embodiment is advantageous since it affords a reduction in the size of the printer because the cleaning roller also fulfils the function of transport roller when it is associated with another roller.

Advantageously, the passage of the flipping device from the first position to the second position on the one hand and the passage from the second position to the other first position on the other hand are rotations through 90° degrees.

The features of the invention mentioned above, as well as others, will emerge more clearly from a reading of the following description of an example embodiment, said description being given in relation to the accompanying drawings, among which:

Figure 1:
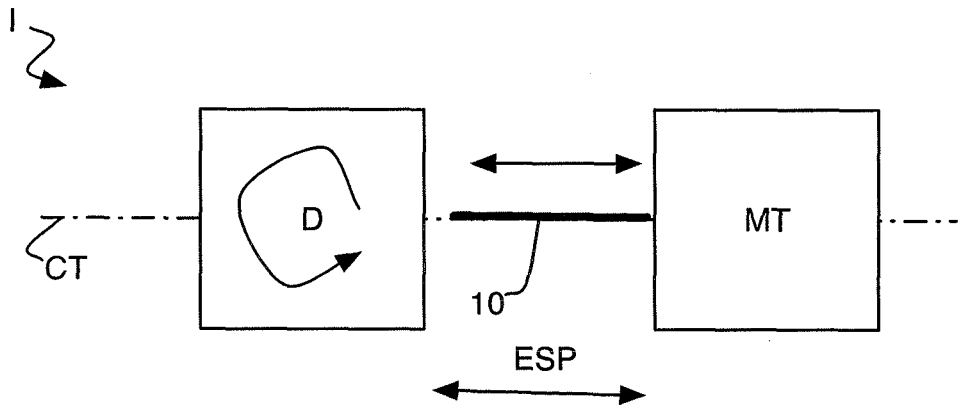
FIG. 1 depicts schematically a printer/card-flipping device assembly of the prior art.
Figure 2:
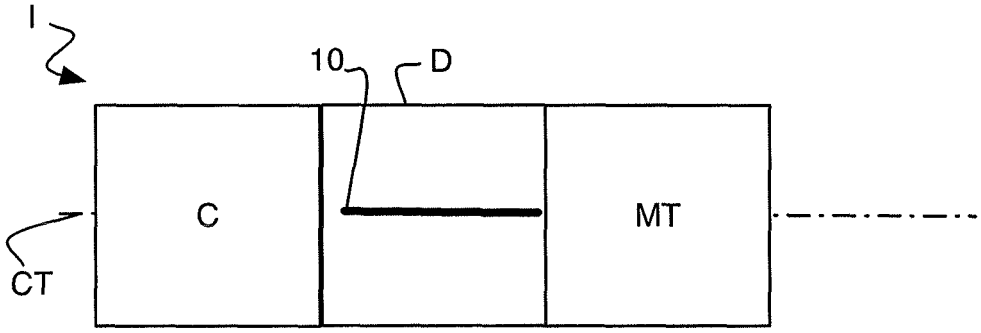
FIG. 2 depicts schematically a printer/card-flipping device assembly according to the present invention.

FIG. 2 depicts schematically an assembly consisting of printer I and card-flipping device D according to the present invention. The device D comprises card-driving means for transferring cards from the printer to the inside of this flipping device, holding them in position in this flipping device, flipping them and transferring them once flipped from the inside of this flipping device to the printer I. So as to reduce the size of this printer I, it is proposed that these drive means be movable so as to enable the printer to use, in order to manipulate a card 10 during the processing operation performed by the processing modules MT of the printer I, a space inside the device D that is occupied by the drive means when they transfer a card 10 from or to the printer I (to processing modules MT of this printer I).

This principle will be detailed below for an embodiment of the invention, other arrangements being possible without departing from the scope of the present invention.

Figure 3:
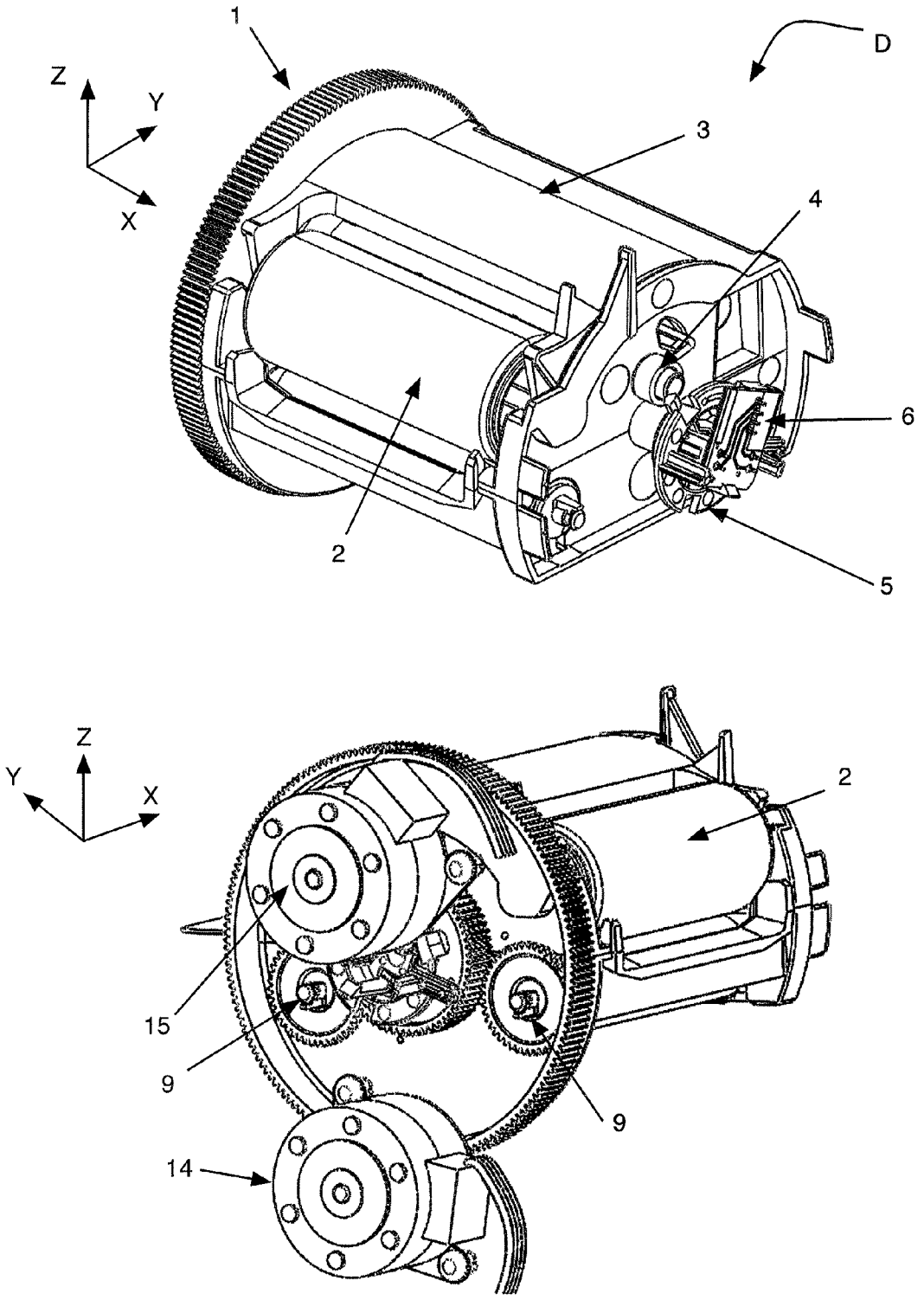
FIG. 3 depicts perspective views of a flipping device according to an embodiment of the present invention.

FIG. 3 depicts perspective views of a flipping device according to an embodiment of the present invention.

Figure 4:
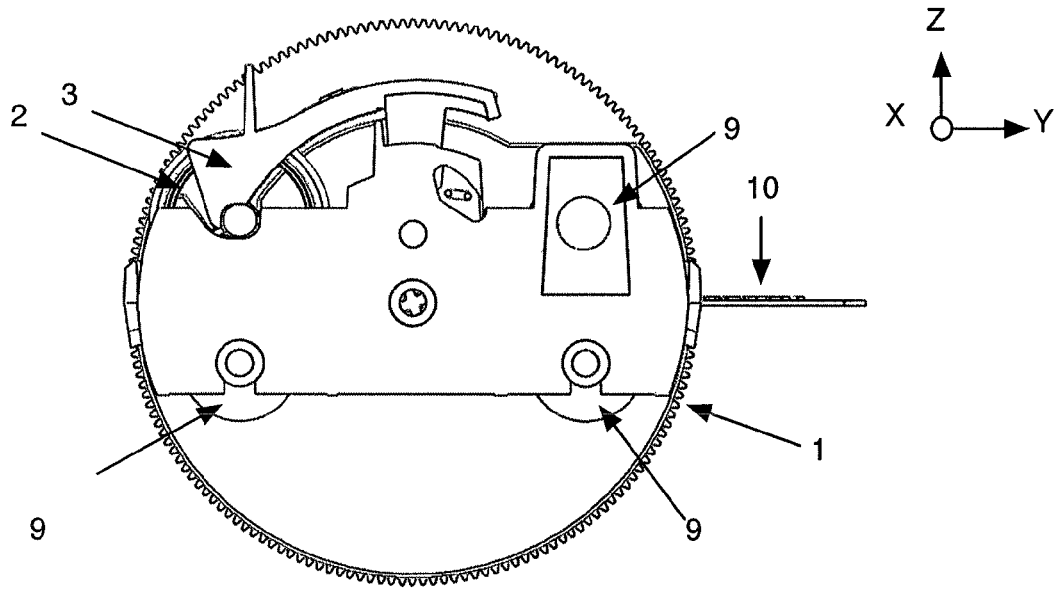
FIG. 4 depicts views in cross section of the flipping device of FIG. 3.
Figure 4:
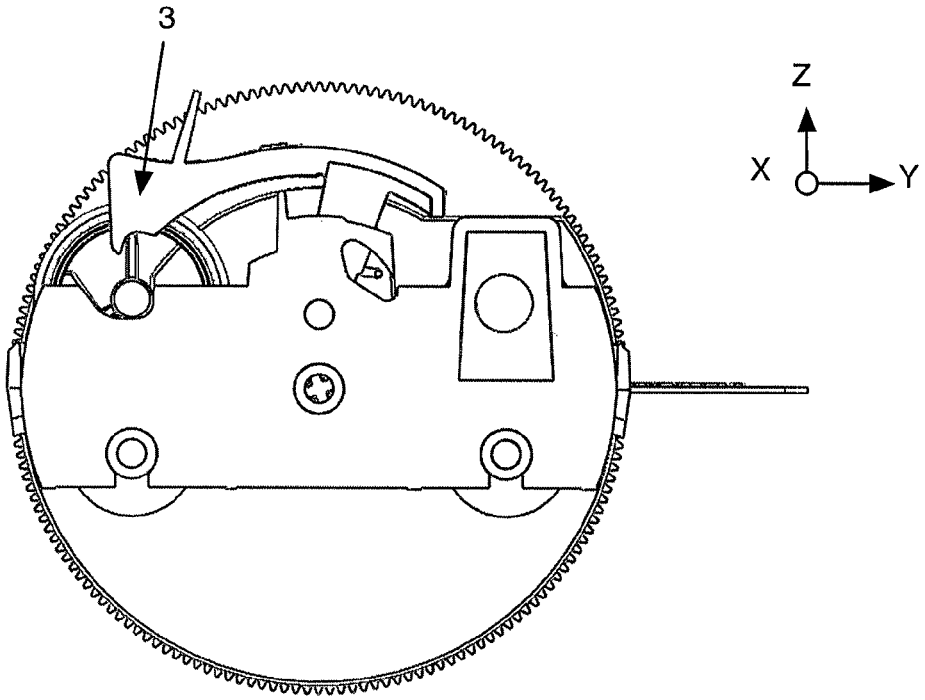

FIG. 4 depicts views in cross section of this device D.

The card-flipping device D comprises, among other things, drive means which are, according to one embodiment, rollers 2 and 9 associated in pairs. According to FIG. 4, the device D comprises two pairs of rollers that are both positioned on a card-transfer path CT carried by an axis Y of a reference frame (X,Y,Z). The card moves along the transfer path CT and the axis Y during an operation performed by the printer.

The device D is fixed to the printer I (not shown) by means of clip pivots 5 that lock by means of a ¼ of a turn and provide the rotation of the assembly. The chassis 1 and the rollers are controlled by two separate stepping motors, a motor 15 for transporting the card and a motor 14 for rotating and flipping the cards.

According to one embodiment, one of the rollers, in this case the one designated by the reference 2, is a roller for cleaning the surface of a card. This roller 2, which is held in position on the device D by a presser 3, also has the function of holding a card in position inside the device D. For this purpose, the roller 2 cooperates with a roller 9 so as to exert opposing pressures on the card, then held by gripping. The card is also held in position by the other pair of rollers 9 (top of FIG. 4). The presser 3 is depicted at the top of FIG. 4 in the position of locking the roller 2. This position of the presser 3 is due to a return spring 4. At the bottom of FIG. 4, the presser 3 is in the unlocking position so that the roller 2 is changed. This position corresponds to the holding of the presser 3 by hand. This change of roller is very easy since it does not require any tools.

The device D also comprises an electronic card 6 that is associated with an assembly formed by a card-presence flag 7 and an optoelectronic sensor 8. The function of this assembly is given later.

Figure 5:
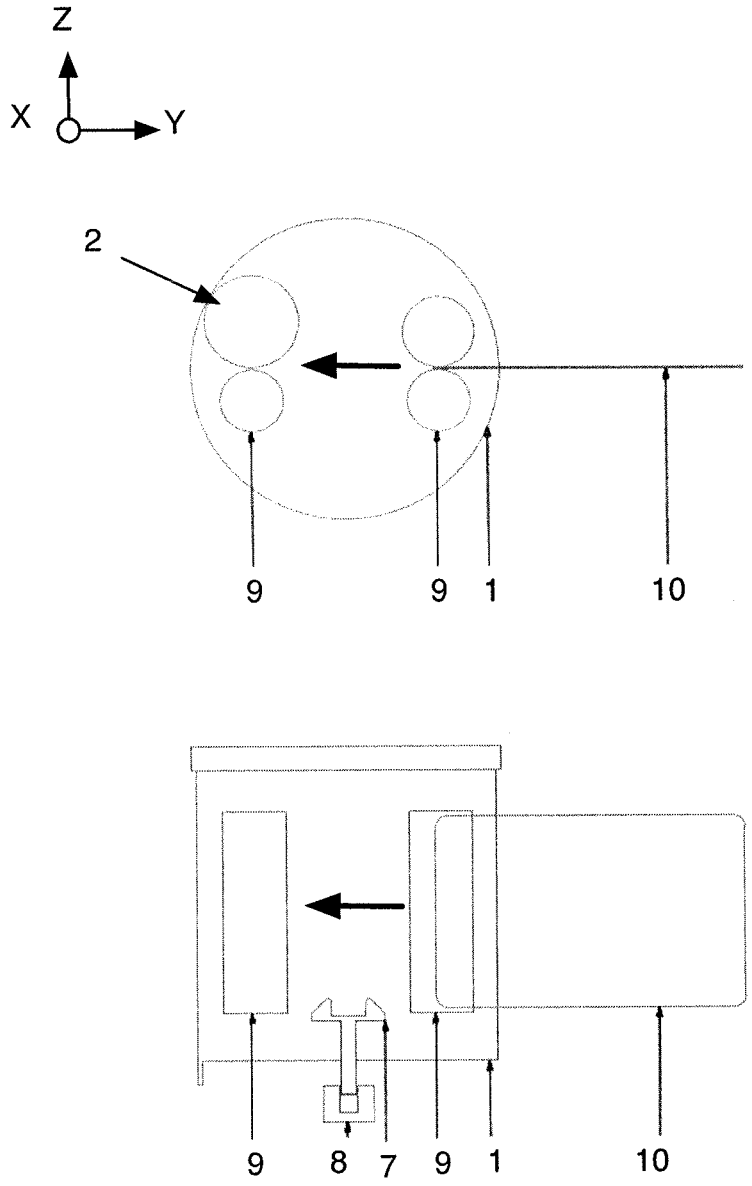
FIG. 5 depicts schematically the transport and detection of a card by the device of FIG. 3.

FIG. 5 depicts schematically the transport and detection of a card by a device D provided according to the present invention.

Figure 6:
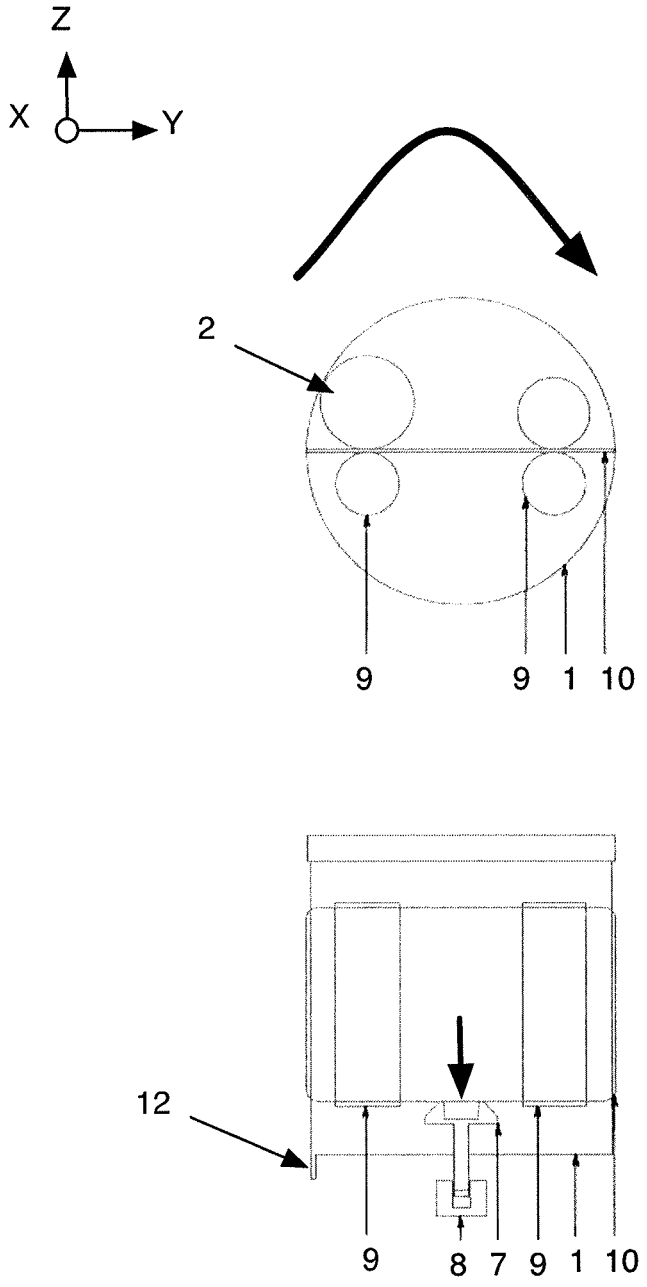
FIG. 6 depicts schematically the flipping device when it is situated in a first position.

When no card is present inside the device D, the card-presence flag 7 is in the high position, that is to say in a position that does not cut the beam of the optoelectronic sensor 8. The drive means are then in a first position for transferring a card from the printer I. When a card 10 coming from the printer I (or more exactly from a processing module MT) enters the device D through one side (here the right), the card 10 is transferred by the pair of rollers 9 to the inside of the device D until it comes up against a bevel on the card-presence flag 7. The card 10 then continues its transfer and then applies a force to this card-presence flag 7 causing movement (here vertical) thereof as illustrated at the bottom of FIG. 6. The beam of the optoelectronic sensor 8 is then cut, sending a presence signal to the card 6 for analysis. The position of the card is then detected precisely. The transport movement provided by a stepping motor participates in the precise advancement of the card.

It should be noted that a loader C may optionally be placed at the entrance of the device D (FIG. 2). A card to be printed then passes through the device D for a first time, from left to right in FIG. 2, so that the front face of the card passes under the cleaning roller 2, which thus removes from it any dirt that may cause printing defects.

Figure 7:
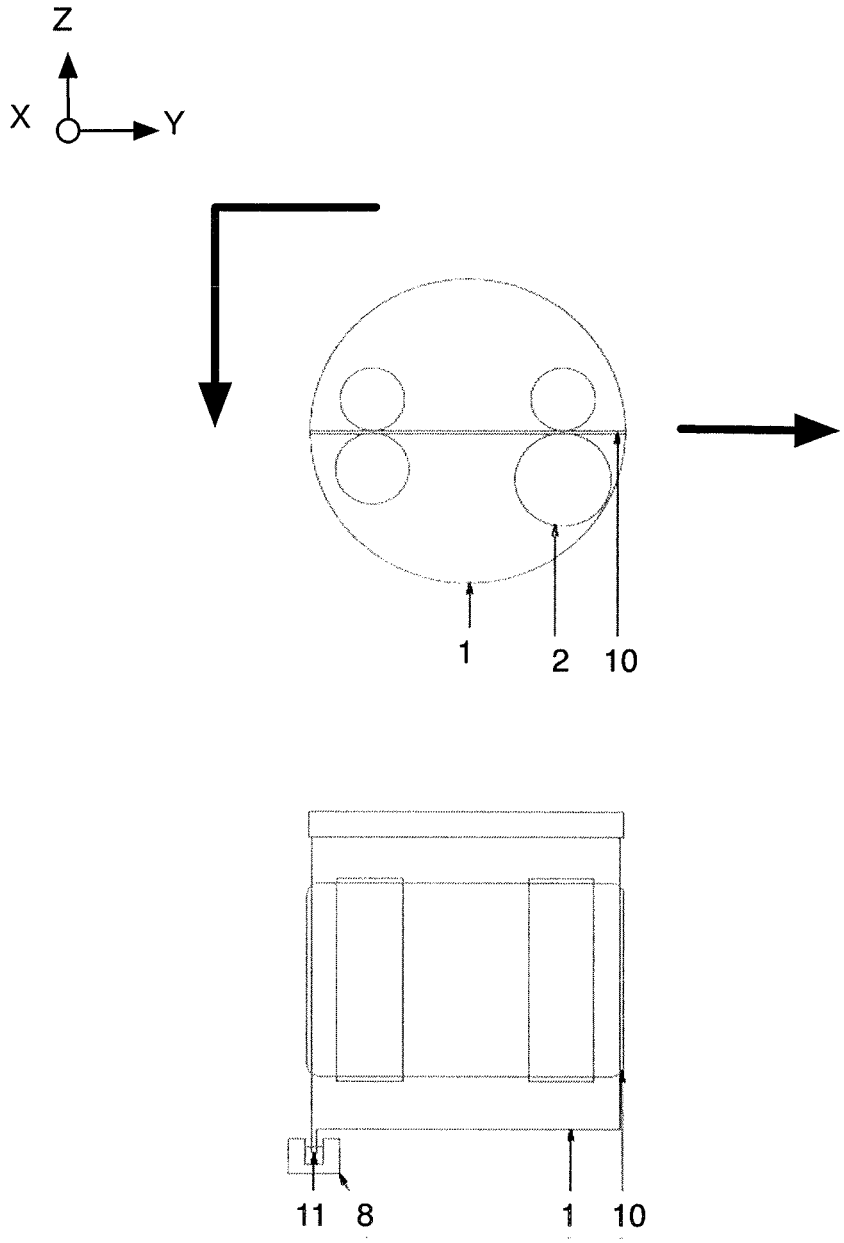
FIG. 7 depicts schematically the flipping device when it is situated in a first position and has flipped a card.

Once the front face is printed, the card returns to the device D, which flips it (a rotation through 180° illustrated in FIG. 6 by the arrow). The device D is then in the position in FIG. 7, which is also referred to as the first position. The card 10 then emerges from the device D (along the bold arrow) in order to be transferred to the processing modules MT.

According to another embodiment, once the front face is printed, the flipping device D effects a rotation (rotation through 180° illustrated in FIG. 6 by the arrow) and the flipping device D is then in a second first position (FIG. 7), and the card returns to the device D, which then cleans the reverse side of the card by means of the cleaning roller 2 before it is processed by the modules MT. This device D therefore provides the cleaning on both faces by means of a single cleaning roller 2. The card 10 then emerges from the device D (along the bold arrow) in order to be transferred to the processing modules MT. On this occasion, the reverse side of the card is cleaned by the cleaning roller 2 before it is processed by the modules MT. This device D therefore provides the cleaning of both faces by means of a single cleaning roller 2.

It should be noted that the angular position of the device D is known by means of a detector 11 associated with another optoelectronic sensor 8 and by a control of the stepping motor 14 implemented, for example, by the card 6.

Figure 8:
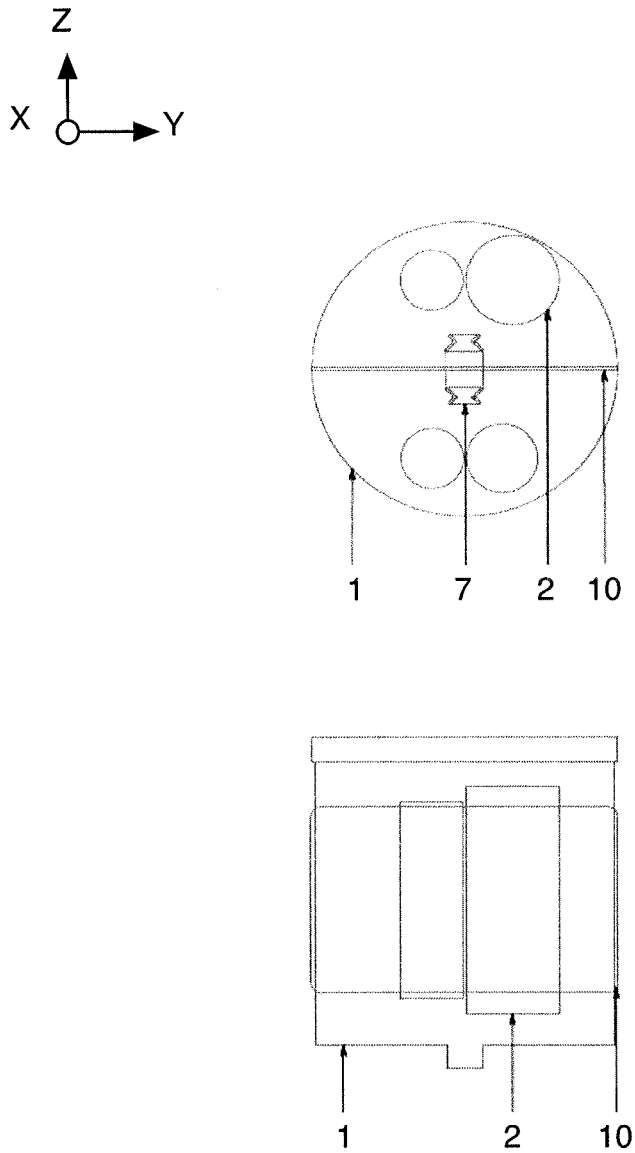
FIG. 8 depicts schematically the flipping device when it is situated in a second position.

When one or other face of the card 10 is processed by the processing modules MT, the device pivots through 90° about its axis (FIG. 7) in order to be in a second position illustrated in FIG. 8. This rotation retracts the drive means 2 and 9 and the card-presence flag 7 from the transfer path CT. In the second position, the space inside the device that is occupied by the drive device means when they are positioned in the first position is left clear.

Figure 9:
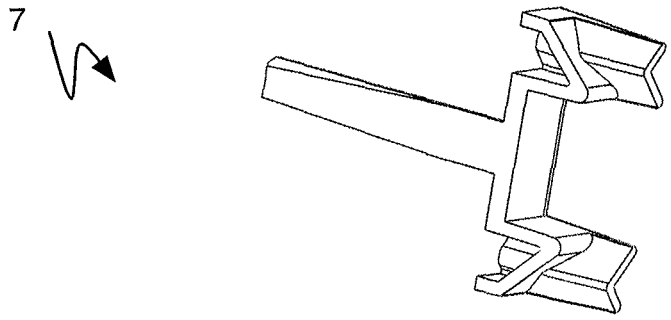
FIG. 9 depicts the parts used for detecting the presence of the card in the flipping module.

For this purpose, the particular U shape of the card-presence flag 7 illustrated in FIG. 9 should be noted. Other forms may obviously be chosen for this flag without departing from the scope of the present invention.

The retraction of the drive means 2 and 9 and the card-presence flag 7 releases a free space in the device D that is occupied by these drive means 2 and 9 when they are positioned in the first position. This space can be used by a card 10 during a processing operation performed by the processing modules MT since the card 10 can freely enter and leave the device D without its coming into contact with the drive means 2 and 9. The card-processing operations then take place without impact since the card strikes neither the rollers 9 nor the cleaning roller 10. This retraction then makes it possible to reduce the length of the printer I by moving the flipping device 9 as close as possible to the processing modules T as illustrated in FIG. 2.

The invention claimed is:

1. Printer for a card comprising:

a transfer path along which said card moves, a processing module intended to perform a processing operation on said card, a flipping device comprising means for driving the card, the flipping device being able to move in rotation between a first position in which said drive means are positioned on the transfer path, another first position in which said drive means are positioned on the transfer path at 180° with respect to said first position, and a second position in which said drive means are not positioned on the transfer path, and a motor intended to position the flipping device in said first position so as to transfer said card from the processing module to the flipping device, in said other first position, so as to transfer said card from the flipping device to the processing module, and in the second position when the card is processed by the processing module.

2. Printer according to claim 1, wherein the drive means are rollers functioning in pairs.

3. Printer according to claim 2, wherein one of the rollers in a pair is a cleaning roller.

4. Printer according to claim 1, wherein the passage of the flipping device from said first position to the second position on the one hand and the passage from the second position to said other first position on the other had are rotations through 90° degrees.

* * * * *